US010892560B2

(12) United States Patent
Nguyen et al.

(10) Patent No.: US 10,892,560 B2
(45) Date of Patent: Jan. 12, 2021

(54) MODULAR ANTENNAS

(71) Applicant: HALLIBURTON ENERGY SERVICES, INC., Houston, TX (US)

(72) Inventors: Minh Dang Nguyen, Singapore (SG); Lay Wei Ang, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 259 days.

(21) Appl. No.: 16/004,294

(22) Filed: Jun. 8, 2018

(65) Prior Publication Data

US 2019/0379131 A1 Dec. 12, 2019

(51) Int. Cl.

| | |
|---|---|
| ***H01Q 7/00*** | (2006.01) |
| ***H01Q 21/00*** | (2006.01) |
| ***E21B 47/00*** | (2012.01) |

(52) U.S. Cl.

CPC ..... *H01Q 21/0025* (2013.01); *E21B 47/00* (2013.01); *H01Q 7/00* (2013.01)

(58) Field of Classification Search

CPC ..... H01Q 21/0025; H01Q 1/40; H01Q 1/04; E21B 47/00; E21B 47/13; E21B 47/017

See application file for complete search history.

(56) References Cited

U.S. PATENT DOCUMENTS

| | | | | |
|---|---|---|---|---|
| 5,138,263 | A | 8/1992 | Towle | |
| 5,661,402 | A | 8/1997 | Chesnutt et al. | |
| 6,025,807 | A * | 2/2000 | Jon | H01Q 7/00 343/742 |
| 6,366,089 | B1 | 4/2002 | Poitzsch et al. | |
| 2004/0061622 | A1* | 4/2004 | Clark | G01V 3/28 340/854.6 |
| 2010/0117454 | A1* | 5/2010 | Cook | G06K 7/10316 307/104 |
| 2011/0074427 | A1 | 3/2011 | Wang et al. | |
| 2013/0255966 | A1 | 10/2013 | Palaghita et al. | |
| 2015/0061682 | A1 | 3/2015 | Homan et al. | |
| 2015/0201459 | A1* | 7/2015 | Sato | H01Q 21/30 455/552.1 |
| 2016/0241306 | A1* | 8/2016 | Moon | H01Q 1/2208 |
| 2017/0003413 | A1* | 1/2017 | Jachmann | E21B 47/00 |
| 2017/0269254 | A1* | 9/2017 | Ma | E21B 47/13 |

FOREIGN PATENT DOCUMENTS

WO WO20170655721 * 4/2017

OTHER PUBLICATIONS

International Search Report for Application No. PCT/US2019/030456, dated Aug. 16, 2019.

* cited by examiner

*Primary Examiner* — Awat M Salih

(74) *Attorney, Agent, or Firm* — John Wustenberg; C. Tumey Law Group PLLC

(57) ABSTRACT

An antenna assembly includes a first antenna section, a first housing section, a second antenna section, and a second housing section. The first antenna section includes a first antenna coil portion, and a first magnetic band disposed on the first antenna coil portion. The first housing section is configured to receive the first antenna coil portion and the first magnetic band. The second antenna section includes a second antenna coil portion, and a second magnetic band disposed on the second antenna coil portion. The second housing section is configured to receive the second antenna coil portion and the second magnetic band.

13 Claims, 8 Drawing Sheets

MODULAR ANTENNAS

FIELD

This disclosure relates, in general, to antennas used in electromagnetic logging tools and, in particular, to loop antennas formed using two antenna coil portions coupled to each other.

BACKGROUND

During drilling operations for the extraction of hydrocarbons, a variety of recording and transmission techniques are used to provide or record real-time data from the vicinity of a drill bit. Measurements of surrounding subterranean formations may be made throughout drilling operations using downhole measurement and logging tools, such as measurement-while-drilling (MWD) tools, which aid in making operational decisions, and logging-while-drilling (LWD) tools, which help characterize the formations. LWD tools in particular obtain measurements of the subterranean formations being penetrated for determining the electrical resistivity (or its inverse, conductivity) of the subterranean formations, where the electrical resistivity indicates various geological features of the formations. These resistivity measurements may be taken using one or more antennas coupled to or otherwise associated with the wellbore logging tools. The measurements may be processed downhole or the measurements may be communicated to a surface location for processing.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The present disclosure relates generally to logging tool antennas for wellbore logging tools used in the oil and gas industry and, more particularly, to loop antennas formed from two or more discrete component parts assembled together.

A modular loop antenna according to some embodiments disclosed may include two component parts that may be coupled together. The component parts may be manufactured such that the size and shape of the antenna coil portions included in the component parts are maintained. This results in matched antennas, and the sensitivity of the wellbore logging tool is improved. Further, the component parts can be assembled and disassembled with relative ease, thereby permitting repair and maintenance of the antennas in the field and in shorter time duration. This improves asset utilization by reducing downtime since it may not be required to ship the wellbore logging tool to manufacturing facilities. Additionally, if a component part is damaged and needs to be replaced, only the damaged component part may be replaced and the whole antenna does not need replacement. Although embodiments disclosed include loop antennas formed using two component parts, the number of component part is not limited in this regard and the loop antenna may be formed from more than two component parts, without departing from the scope of the disclosure.

Figure 1:
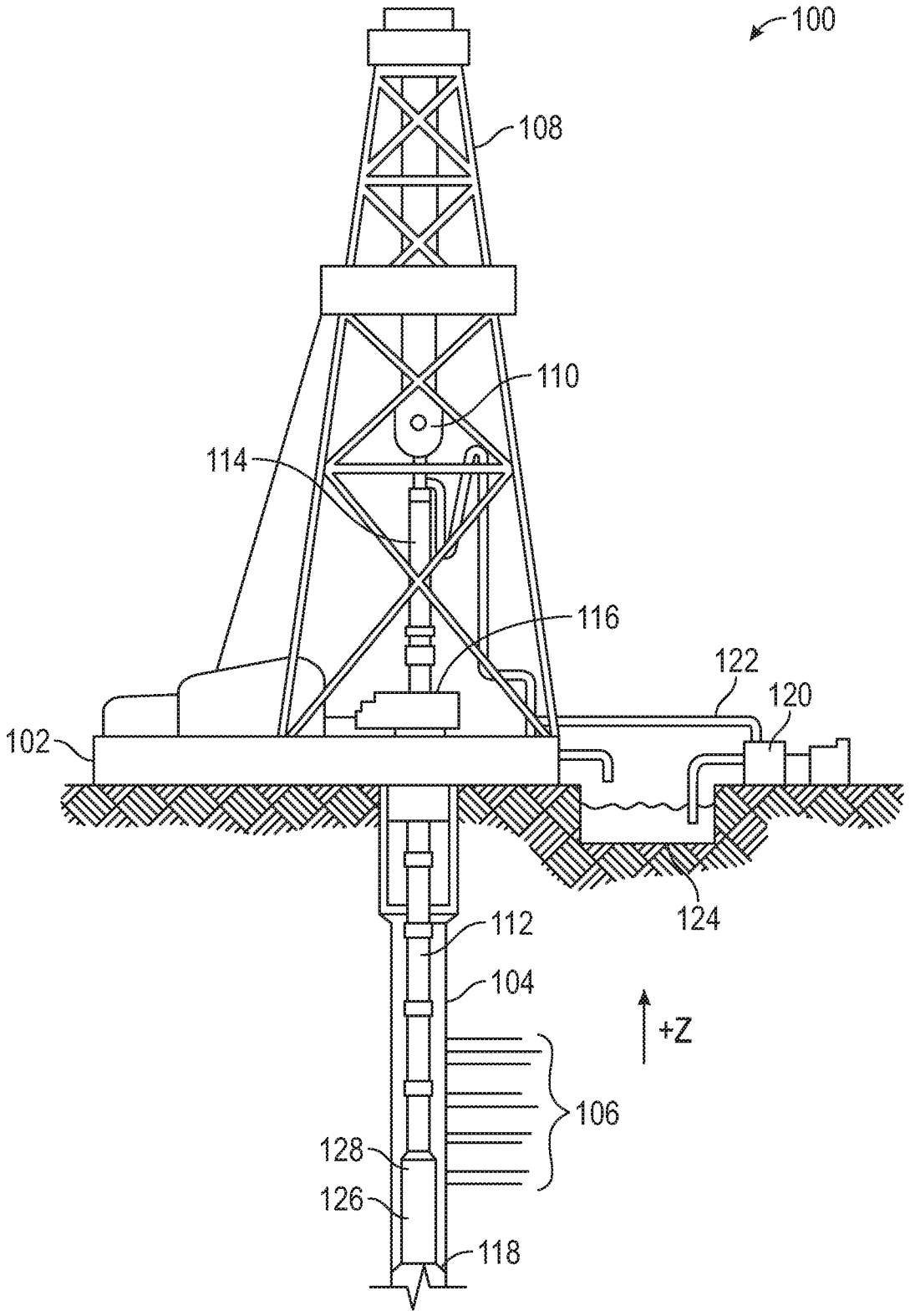
FIG. 1 is a schematic diagram of an example drilling system that may employ the principles of the present disclosure.

FIG. 1 is a schematic diagram of an example drilling system 100 that may employ the principles of the present disclosure, according to one or more embodiments. As illustrated, the drilling system 100 may include a drilling platform 102 positioned at the surface and a wellbore 104 that extends from the drilling platform 102 into one or more subterranean formations 106.

The drilling system 100 may include a derrick 108 supported by the drilling platform 102 and having a traveling block 110 for raising and lowering a drill string 112. A kelly 114 may support the drill string 112 as it is lowered through a rotary table 116. A drill bit 118 may be coupled to the drill string 112 and driven by a downhole motor and/or by rotation of the drill string 112 by the rotary table 116. As the drill bit 118 rotates, it creates the wellbore 104, which penetrates the subterranean formations 106. A pump 120 may circulate drilling fluid through a feed pipe 122 and the kelly 114, downhole through the interior of drill string 112, through orifices in the drill bit 118, back to the surface via the annulus defined around drill string 112, and into a retention pit 124. The drilling fluid cools the drill bit 118 during operation and transports cuttings from the wellbore 104 into the retention pit 124.

The drilling system 100 may further include a bottom hole assembly (BHA) coupled to the drill string 112 near the drill bit 118. The BHA may comprise various downhole measurement tools such as, but not limited to, measurement-while-drilling (MWD) and logging-while-drilling (LWD) tools, which may be configured to take downhole measurements of drilling conditions. The MWD and LWD tools may include at least one resistivity logging tool 126, which may comprise at least one antenna, according to embodiments disclosed, formed using two antenna coil portions coupled to each other.

As the drill bit 118 extends the wellbore 104 through the formations 106, the resistivity logging tool 126 may continuously or intermittently collect azimuthally-sensitive measurements relating to the resistivity of the formations 106, i.e., how strongly the formations 106 opposes a flow of electric current. The resistivity logging tool 126 and other sensors of the MWD and LWD tools may be communicably coupled to a telemetry module 128 used to transfer measurements and signals from the BHA to a surface receiver (not shown) and/or to receive commands from the surface receiver. The telemetry module 128 may encompass any known means of downhole communication including, but not limited to, a mud pulse telemetry system, an acoustic telemetry system, a wired communications system, a wireless communications system, or any combination thereof. In certain embodiments, some or all of the measurements taken at the resistivity logging tool 126 may also be stored within the resistivity logging tool 126 or the telemetry module 128 for later retrieval at the surface upon retracting the drill string 112.

Figure 2:
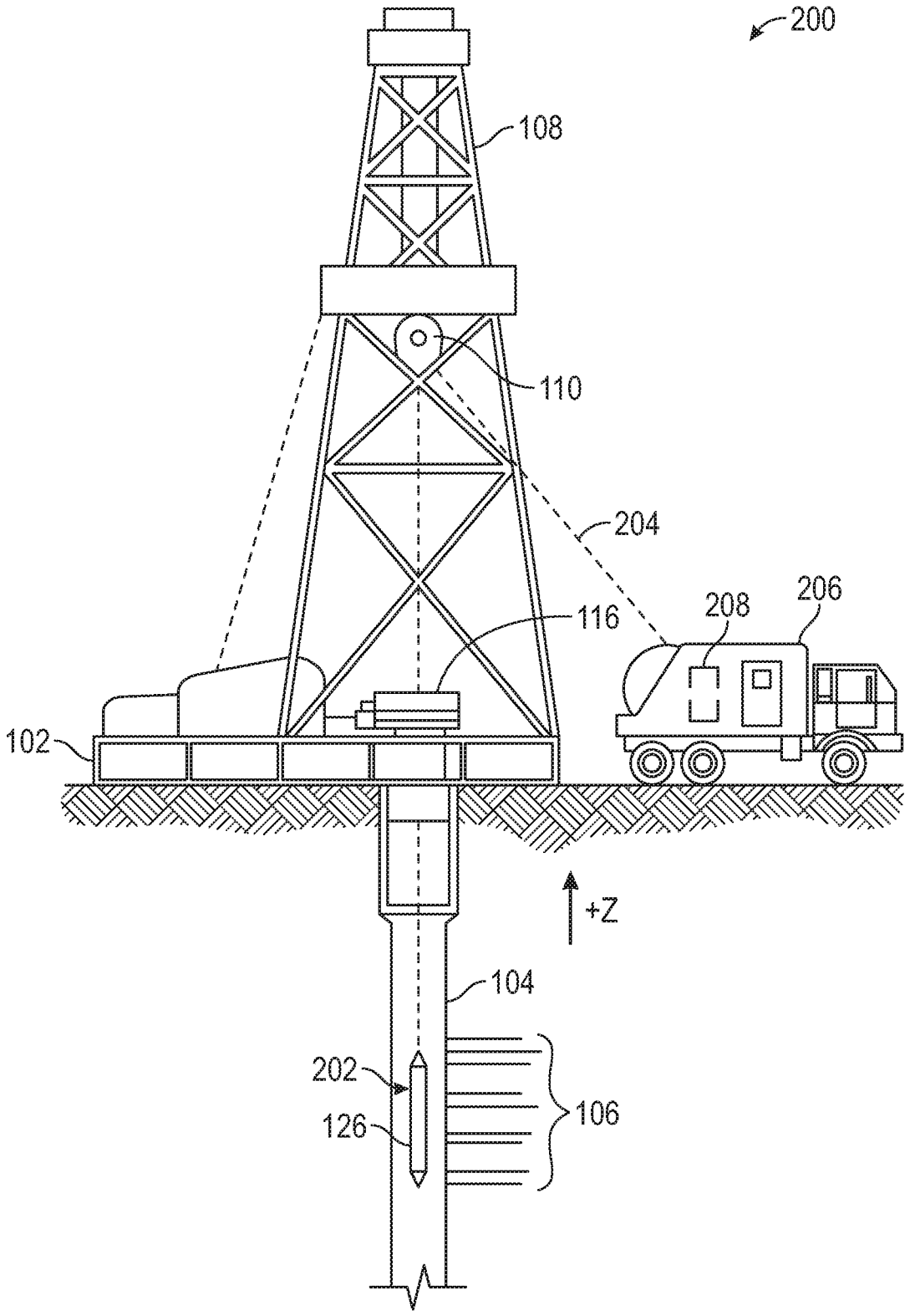
FIG. 2 is a schematic diagram of an example wireline system that may employ the principles of the present disclosure.

At various times during the drilling process, the drill string 112 may be removed from the wellbore 104, as shown in FIG. 2, to conduct measurement/logging operations. More particularly, FIG. 2 is a schematic diagram of an example wireline system 200 that may employ the principles of the present disclosure, according to one or more embodiments. Like numerals used in FIGS. 1 and 2 refer to the same components or elements and, therefore, may not be described again in detail. As illustrated, the wireline system 200 may include a wireline instrument sonde 202 that may be suspended in the wellbore 104 on a cable 204. The sonde 202 may include the resistivity logging tool 126 described above, which may be communicably coupled to the cable 204. The cable 204 may include conductors for transporting power to the sonde 202 and also facilitate communication between the surface and the sonde 202. A logging facility 206, shown in FIG. 2 as a truck, may collect measurements from the resistivity logging tool 126, and may include computing and data acquisition systems 208 for controlling, processing, storing, and/or visualizing the measurements gathered by the resistivity logging tool 126. The computing and data acquisition systems 208 may be communicably coupled to the resistivity logging tool 126 by way of the cable 204.

Even though FIGS. 1 and 2 depict the systems 100 and 200 including vertical wellbores, it should be understood by those skilled in the art that principles of the present disclosure are equally well suited for use in wellbores having other orientations including horizontal wellbores, deviated wellbores, slanted wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIGS. 1 and 2 depict an onshore operation, it should be understood by those skilled in the art that principles of the present disclosure are equally well suited for use in offshore operations, wherein a volume of water may separate the drilling platform 102 and the wellbore 104.

Figure 3A:
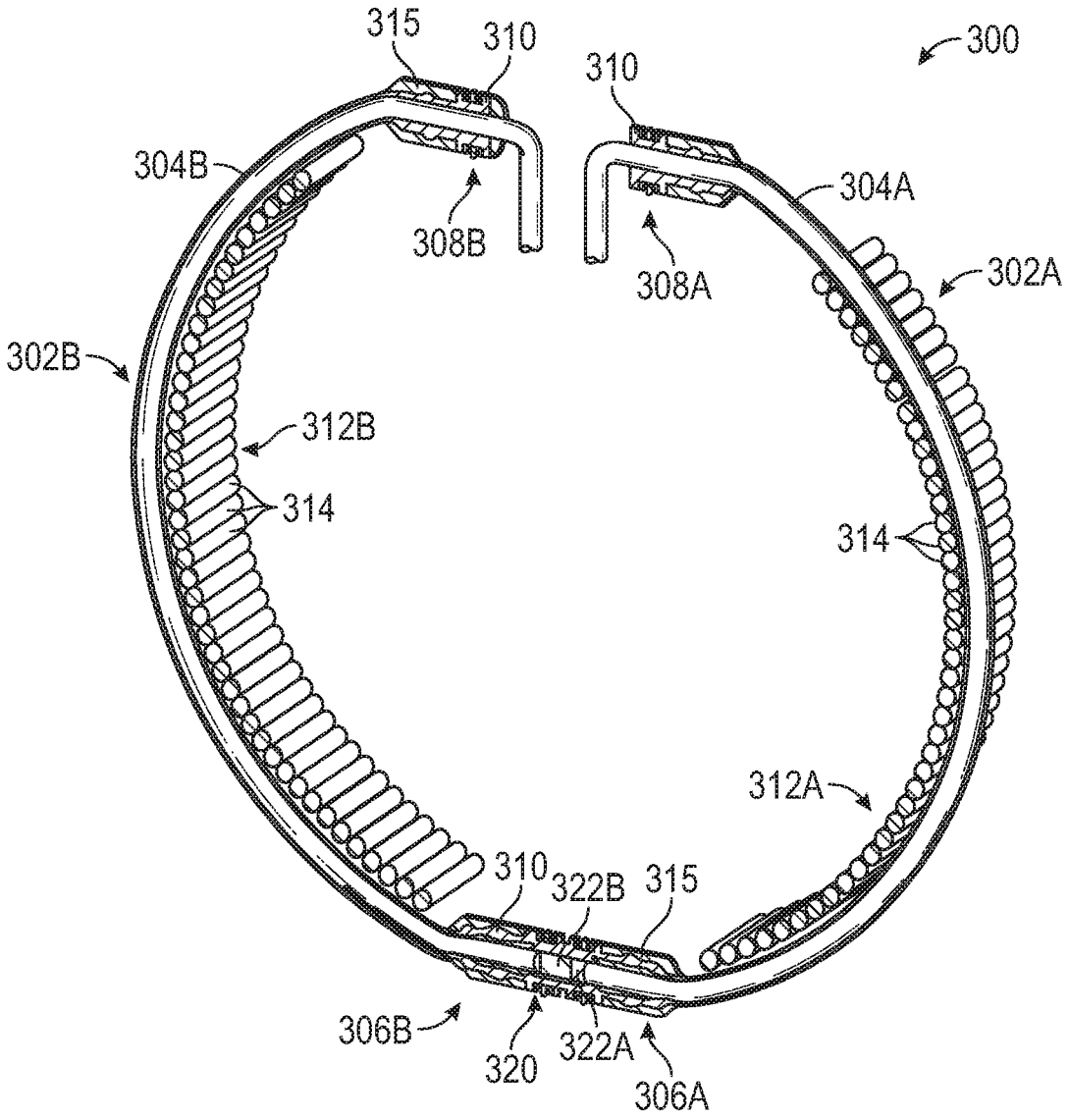
FIG. 3A illustrates an isometric view of an antenna used in the resistivity logging tool in the drilling or wireline systems of FIGS. 1 and 2, according to embodiments disclosed.

FIG. 3A illustrates an isometric view of an antenna assembly 300, according to embodiments disclosed. The antenna assembly 300 may be used in the resistivity logging tool 126 of FIGS. 1 and 2 and, therefore, may be used in the drilling or wireline systems 100, 200 depicted therein. In an example, and as illustrated, the antenna assembly 300 may include two generally semi-circular antenna sections 302A and 302B (collectively, antenna sections 302), each antenna section 302A and 302B including semi-circular antenna coil portions 304A and 304B (collectively antenna coil portions 304), respectively. Each antenna coil portion 304A and 304B may include a same number of conductive wires. The antenna coil portion 304A may include a first or "bottom" end 306A and a second or "top" end 308A opposite the first end 306A. Similarly, the antenna coil portion 304B may include a first or "bottom" end 306B and a second or "top" end 308B opposite the first end 306B. The antenna coil portions 304A and 304B are coupled to each other via their respective first ends 306A and 306B to form a loop antenna. The respective second ends 308A and 308B of the antenna coil portions 304A and 304B are connected to a control circuitry (not shown) for controlling an operation of the loop antenna. For instance, the control circuitry may control an operation of the loop antenna to transmit and receive EM signal to and from the subterranean formations 106 (FIG. 1). The control circuitry may be enclosed in a housing (not shown) located in the resistivity logging tool 126.

A coupler 320 (e.g., a "nano" coupler illustrated in FIG. 3B) may operatively connect the first ends 306A and 306B of the antenna coil portions 304. The coupler 320 may be enclosed within a metal housing 310 to protect the coupler 320 from downhole pressure and wellbore fluids to limit damage to the coupler 320 and conductive wires of the antenna coil portions 304. Similar metal housings 310 may be coupled to the antenna portions 304 adjacent the second ends 308A and 308B of the antenna coil portions 304. The antenna coil portions 304 and the metal housing 310 may be encapsulated within a rubber (or similar) coating 315 to minimize corrosion. The antenna coil portions 304 at the second ends 308A and 308B may be exposed for connecting to the control circuitry of the loop antenna.

Each antenna section 302 may include a soft magnetic band 312 (312A and 312B) that may comprise a generally semi-circular structure that extends on the radially inner surface of each antenna section 302. Thus, when the antenna assembly 300 is disposed on the resistivity logging tool 126, the soft magnetic band 312 may radially interpose the antenna coil portions 304 and the resistivity logging tool 126 and may extend at least partially about a circumference of the resistivity logging tool 126. The soft magnetic band 312 may be configured to shield the antenna coil portions 304 from eddy currents generated by the resistivity logging tool 126, thereby increasing the azimuthal sensitivity of the loop antenna and/or increasing the efficiency or strength of a dipole magnetic field generated by the antenna coil portions 304. To facilitate this effect, the soft magnetic band 312 may comprise a soft magnetic material or any material that exhibits relatively high resistivity, high magnetic permeability, and low magnetic loss (e.g., hysteresis, magnetostriction, etc.). One suitable soft magnetic material that may be used includes ferrites, which generally comprise a composite mixture of a powder iron/ferrite material and a binder, such as a silicone-based rubber, an elastomer, an RTV, a polymer (such as polyimide), a ceramic, or an epoxy. The resulting mixture is molded and/or pressed into desired geometric shapes and configurations that conform to the shape of the soft magnetic band 312. Other suitable soft magnetic materials that may be used in the soft magnetic band 312 include, but are not limited to, mu-metal, permalloy, metallic glass (metglass), or any combination of the foregoing. In the illustrated example, the soft magnetic band 312 comprises a plurality of inserts 314 that form a semi-circular structure extending on the radially inner surface of the antenna sections 302.

Figure 4:
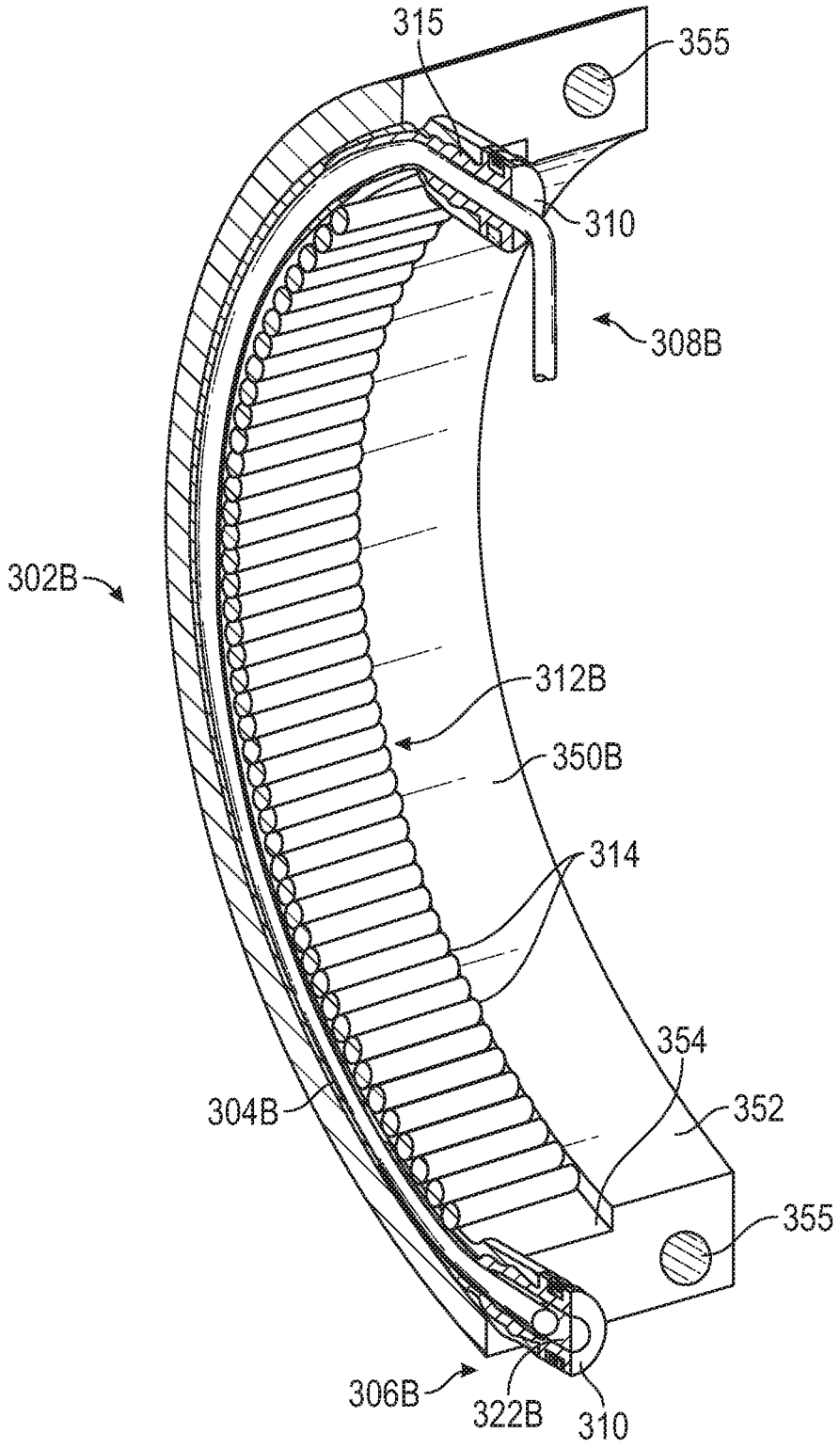
FIG. 4 illustrates an isometric view of a housing section including an antenna portion of FIG. 3A installed therein, according to embodiments disclosed.

The plurality of inserts 304 are illustrated as generally elongated rod like structures having one end thereof coupled to the inner surface of the antenna sections 302. The remaining portion of the insert 314 may be supported by a housing 350 (FIG. 4). The rods of each insert 304 may comprise straight, cylindrical members that provide a circular or polygonal cross-section. In other words, each rod may exhibit a cross-sectional shape that is circular, such as rounded, oval, or ovoid, or alternatively a cross-sectional shape that is polygonal, such as, triangular, rectangular (including square), pentagonal, etc. In the illustrated example, the rods are depicted as cylindrical members with a circular cross-section. In some embodiments, a given stacked insert 304 may comprise rods having dissimilar cross-sectional shapes, without departing from the scope of the disclosure.

Figure 3B:
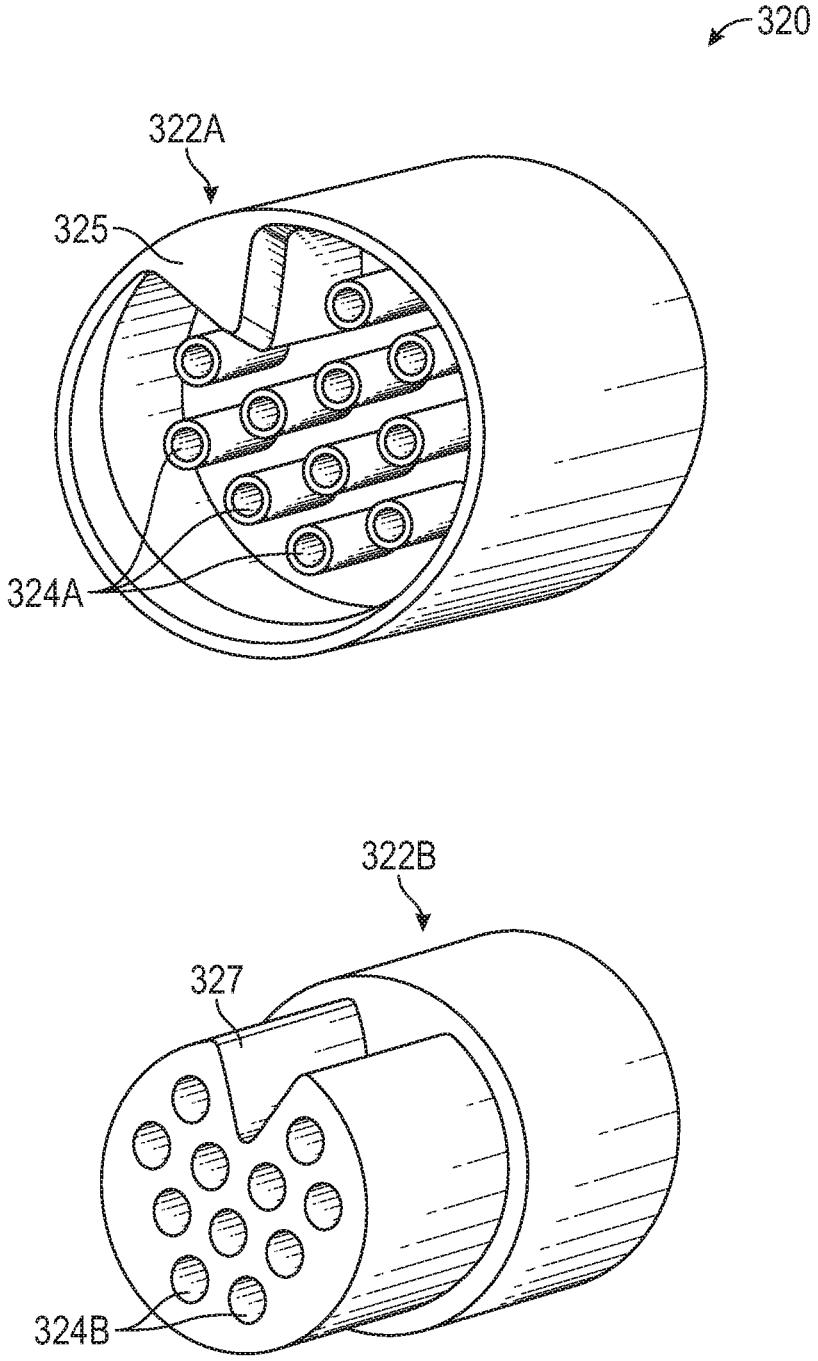
FIG. 3B illustrates a connector for connecting the ends of the antenna coils in FIG. 3A.

Referring to FIG. 3B, with continued reference to FIG. 3A, illustrated is the coupler 320 for operatively connecting the first ends 306A and 306B of the antenna coil portions 304. The coupler 320 may include a first part 322A and a second part 322B. In an example, the first part 322A may be connected to the antenna coil portion 304A and the second part 322B may be connected to the antenna coil portion 304B. However, the connections are not limited in this regard and may be reversed. The coupler 320 permits multiple conductive wires forming the antenna coil portions 304 to be connected to each other at a time. In the absence of the coupler 320, each conductive wire from an antenna coil portion is required to be individually connected to a corresponding wire in the other antenna coil portion. This is a time consuming and tedious process with relatively high chances of failure (e.g., misconnection between the wires). The coupler 320 thus simplifies the process of assembling and disassembling the antenna coil portions 304.

The first part 322A includes a first type of connectors 324A each corresponding to a second type of connector 324B in the second part 322B. In an example, and as illustrated, the first type of connector may be referred to as a male connector and the second type of connector may be referred to as a female connector. As mentioned above, each antenna coil portion 304A and 304B may include multiple conductive wires bonded together. The number of male and female connectors 324A and 324B are equal to the number of wires in the antenna coil portions 304. Each male connector 324A may receive a single conductive wire of the antenna coil portion 304A and each female connector 324B may receive a single conductive wire of the antenna coil portion 304B. Thus, when the first part 322A is coupled to the second part 322B, each male connector 324A may be received in a corresponding female connector 324B and the corresponding conductive wires may contact each other, thereby connecting the antenna coil portions 304 to each other and forming the loop antenna. In order to ensure correct orientation when connecting the first and second parts 322A and 322B, the first part 322A may include a projection 325 that may be received in a correspondingly sized and shaped cavity 327 defined in the second part 322B.

Figure 3C:
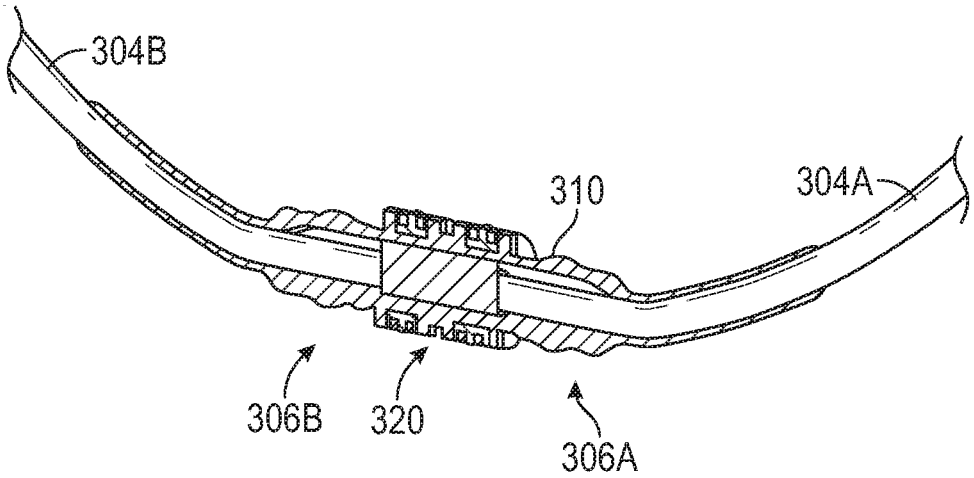
FIG. 3C illustrates the first ends of the antenna coils of FIG. 3A in relatively greater detail, according to embodiments disclosed.
Figure 3D:
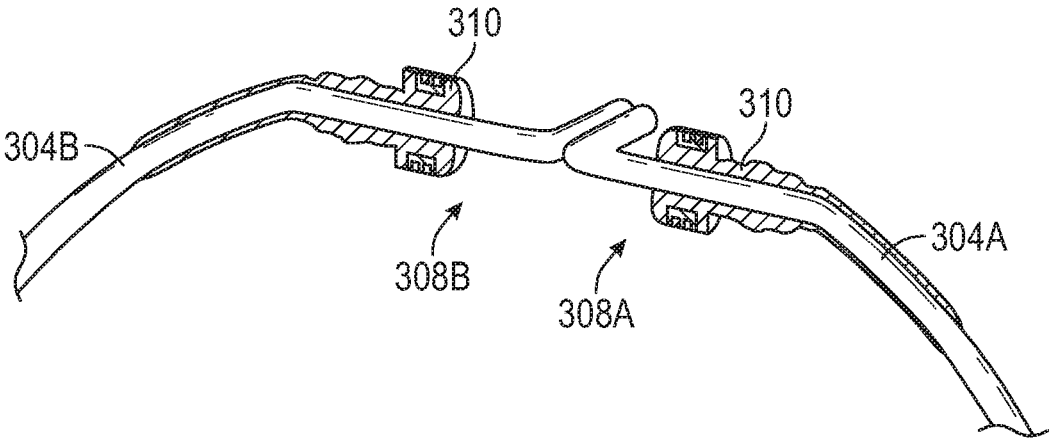
FIG. 3D illustrates the second ends of the antenna coils of FIG. 3A in relatively greater detail, according to embodiments disclosed.

FIG. 3C illustrates the first ends 306A and 306B of the antenna coil portions 304 in relatively greater detail, according to embodiments disclosed. FIG. 3D illustrates the second ends 308A and 308B of the antenna coil portions 304 in relatively greater detail, according to embodiments disclosed. For the sake of illustration, the rubber coating 315 is omitted in FIGS. 3C and 3D. As illustrated, the metal housings 310 extend a certain distance over the antenna coil portions 304. The metal housing 310 at the first ends 306A and 306B may improve stiffness of the antenna coil portions 304 at the first ends 306A and 306B. This makes connecting and disconnecting the antenna coil portions 304 relatively easy. Similarly, the metal housings 310 at the second ends 308A and 308B may improve stiffness of the antenna coil portions 304 at the second ends 308A and 308B. As a result, the antenna coil portions 304 may be connected to the control circuitry with relative ease.

FIG. 4 illustrates an isometric view of a housing section 350B including the antenna section 302B installed therein, according to embodiments disclosed. As illustrated, the housing section 350B may be generally semi-cylindrical. In an example, the housing section 350B may be of fiberglass. The inner circumferential surface 352 of the housing section 350B may include a recess 354 that is sized and shaped to receive the antenna section 302B including the soft magnetic band 312B. The antenna section 302A may be similarly installed in a second housing section 350A (FIG. 5).

The housing section 350B may include through holes 355 at either ends for receiving fasteners for coupling the housing sections 350A and 350B to each other. The housing sections 350A and 350B may form a housing 350 (FIG. 5). In an example, the fasteners may include screws, bolts, clips, and other kinds of fasteners that may be removed without damaging the housing 350 and the antenna sections 302. Thus, the antenna sections 302 can be separated from the logging tool for repair and service, and reused.

The housing section 350B and the antenna section 302B may be encapsulated in epoxy (or similar), thereby forming a unitary structure (one piece). Similarly, the antenna section 302A and the housing section 350A may be encapsulated in epoxy (or similar) to form a unitary structure. The two unitary structures may cooperatively form the antenna assembly 300. The ends 306B and 308B of the antenna section 302B and through holes 355 of the housing section 350B may be exposed for connecting to the antenna section 302A and the housing section 350A. The two antenna sections 302 manufactured in the manner discussed may be matched since they have a same number of conductive wires, a same dimension, and a same winding angle with respect to the tool axis. The two antenna sections 302 may be provided as a set for assembling on the resistivity logging tool 126 (FIGS. 1 and 2) for forming the loop antenna of the resistivity logging tool 126.

Figure 5:
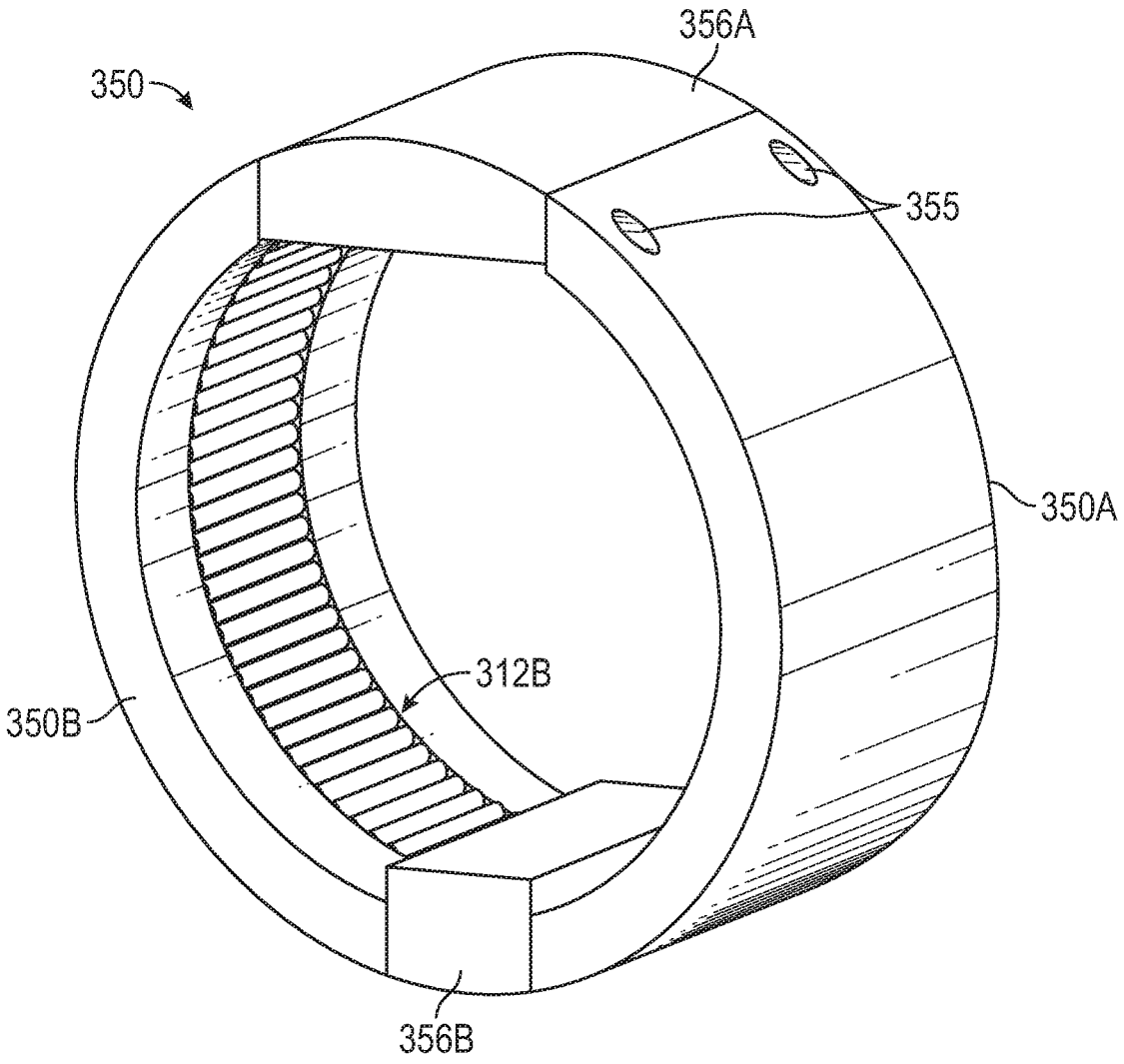
FIG. 5 is an isometric view of a housing, according to embodiments disclosed.

FIG. 5 is an isometric view of the housing 350. For the sake of illustration, the antenna sections 302 are omitted from FIG. 5. However, it will be understood that each antenna section 302 may be disposed between the soft magnetic band 312 and the respective first and second housing sections 350A and 350B. As illustrated, the housing 350 may be generally cylindrical and may include the housing sections 350A and 350B coupled to each other via a first or "top" junction 356A and a second or "bottom" junction 356B. For example, and as illustrated, the first junction 356A may couple the ends of the first and second housing sections 350A and 350B adjacent the second ends 308A and 308B of the antenna coil portions 304A and 304B (FIG. 3A). The second junction 356B may couple the ends of the first and second housing sections 350A and 350B adjacent the first ends 306A and 306B of the antenna coil portions 304A and 304B (FIG. 3A). The first and second housing sections 350A and 350B, and the first and second junctions 356A and 356B cooperatively form the housing 350 that at least partially encloses the loop antenna. The first and second junctions 356A and 356B may have different shapes and sizes. However, in outer embodiments, the first and second junctions 356A and 356B may have similar shapes and sizes. As illustrated, the top surfaces of the inserts 314 forming the soft magnetic band 312 are flush (or aligned) with the inner circumferential surfaces of the first and second housing sections 350A and 350B. Fasteners for removably coupling the housing sections 350A and 350B to each other and for securing the housing 350 on a logging tool (see FIG. 6) may be received in the through holes 355 and may pass through the junctions 356A and 356B.

Figure 6:
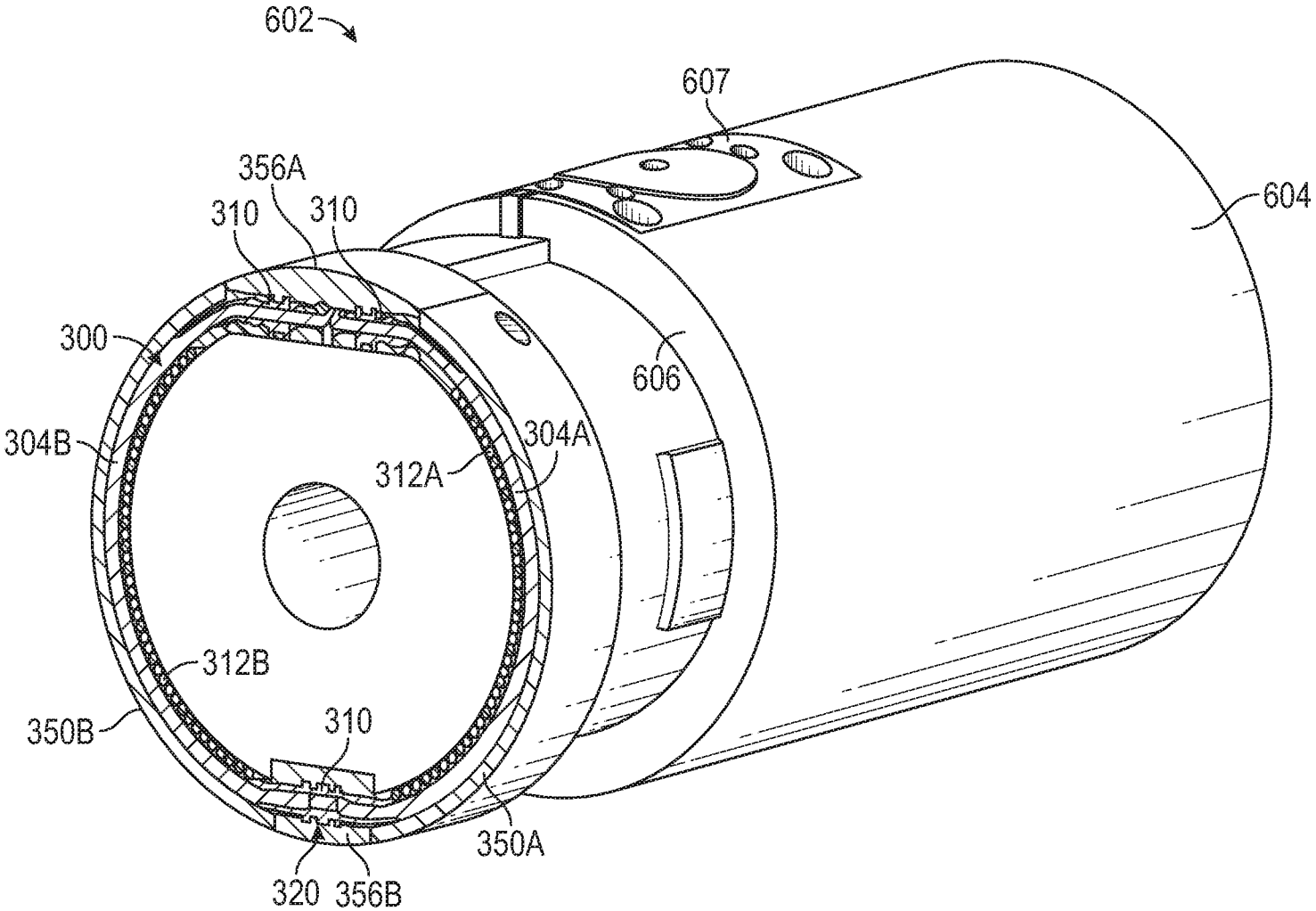
FIG. 6 illustrates a cross-sectional view of the antenna of FIG. 3A and housing of FIG. 5 installed on a wellbore logging tool, according to embodiments disclosed.

FIG. 6 illustrates a cross-sectional view of the housing 350 installed on a wellbore logging tool 602 and including the loop antenna, according to embodiments disclosed. The wellbore logging tool 602 may be the same as or similar to the resistivity logging tool 126 of FIGS. 1 and 2 and, therefore, may be used in the drilling or wireline systems 100, 200 depicted therein. The wellbore logging tool 602 is depicted as including the housing 350 positioned about a tool mandrel 604, such as a drill collar or the like.

As illustrated, the first junction 356A may enclose the top portion of the antenna assembly 300 including the ends 308A and 308B of the antenna coil portions 304 and the metal housings 310. Similarly, the second junction 356B may enclose the bottom portion of the antenna assembly 300 including the ends 306A and 306B of the antenna coil portions 304 and the metal housing 310. The housing 350 may minimize damage of the antenna coil portions 304 and the soft magnetic band 312 due to exposure to wellbore fluids and pressure. The housing 350 may be disposed in a recess 606 defined in the tool mandrel 604. The recess 606 may be sized and shaped (or otherwise configured) to receive the housing 350, the antenna coil portions 304A and 304B, the soft magnetic bands 312A and 312B, and the metal housings 310. When disposed in the recess 606, the outer circumferential surface of the housing 350 and the outer circumferential surface of the tool mandrel 604 may be aligned (e.g., at a same radial distance from the tool axis). The control circuitry for controlling an operation of the loop antenna formed from the antenna coil portions 304 may be included in an enclosure 607 located in a cavity defined in the tool mandrel 604.

Further Considerations

Various examples of aspects of the disclosure are described as numbered clauses (1, 2, 3, etc.) for convenience. These are provided as examples, and do not limit the subject technology. Identifications of the figures and reference numbers are provided below merely as examples and for illustrative purposes, and the clauses are not limited by those identifications.

Clause 1: An antenna assembly, comprising: a first antenna section including: a first antenna coil portion, and a first magnetic band disposed on the first antenna coil portion; a first housing section configured to receive the first antenna coil portion and the first magnetic band; a second antenna section including: a second antenna coil portion, and a second magnetic band disposed on the second antenna coil portion; and a second housing section configured to receive the second antenna coil portion and the second magnetic band.

Clause 2: The antenna assembly of clause 1, further comprising a conductive coupler for coupling first ends of the first and second antenna coil portions to each other to form a loop antenna of the antenna assembly.

Clause 3: The antenna assembly of clause 2, wherein the first and second antenna coil portions each include a plurality of conductive wires.

Clause 4: The antenna assembly of clause 3, wherein second ends of the first and second antenna coil portions are coupled to a control circuit, thereby forming a multi-loop antenna assembly.

Clause 5: The antenna assembly of clause 3, wherein the first and second antenna coil portions include a same number of conductive wires.

Clause 6: The antenna assembly of clause 1, further comprising: a first junction removably coupling first ends of the first and second housing sections and at least partially enclosing first ends of the first and second antenna coil portion; and a second junction removably coupling second ends of the first and second housing sections and at least partially enclosing second ends of the first and second antenna coil portions.

Clause 7: The antenna assembly of clause 1, wherein the first housing section, the first antenna coil portion, and the first magnetic band are bonded together and comprise a first unitary structure, and wherein the second housing section, the second antenna coil portion, and the second magnetic band are bonded together and comprise a second unitary structure, the first and second unitary structures cooperatively forming the antenna assembly.

Clause 8: A logging tool, comprising: a tool mandrel; and an antenna assembly disposed on the tool mandrel, the antenna assembly including: a first antenna section including: a first antenna coil portion, and a first magnetic band disposed on the first antenna coil portion; a first housing section configured to receive the first antenna coil portion and the first magnetic band; a second antenna section including: a second antenna coil portion, and a second magnetic band disposed on the second antenna coil portion; and a second housing section configured to receive the second antenna coil portion and the second magnetic band.

Clause 9: The logging tool of clause 8, further comprising a conductive coupler for coupling the first and second antenna coil portions to each other to form a loop antenna of the antenna assembly.

Clause 10: The logging tool of clause 8, wherein the first and second antenna coil portions each include a plurality of conductive wires.

Clause 11: The logging tool of clause 10, wherein second ends of the first and second antenna coil portions are coupled to a control circuit, thereby forming a multi-loop antenna assembly.

Clause 12: The logging tool of clause 10, wherein the first and second antenna coil portions include a same number of conductive wires.

Clause 13: The logging tool of clause 8, further comprising: a first junction removably coupling first ends of the first and second housing sections and at least partially enclosing first ends of the first and second antenna coil portion; and a second junction removably coupling second ends of the first and second housing sections and at least partially enclosing second ends of the first and second antenna coil portions.

Clause 14: The logging tool of clause 8, wherein the first housing section, the first antenna coil portion, and the first magnetic band are bonded together and comprise a first unitary structure, and wherein the second housing section, the second antenna coil portion, and the second magnetic band are bonded together and comprise a second unitary structure, the first and second unitary structures cooperatively forming the antenna assembly.

Clause 15: A method, comprising: introducing a logging tool into a wellbore, the logging tool including: a tool mandrel; and an antenna assembly disposed on the tool mandrel, the antenna assembly including: a first antenna section including: a first antenna coil portion, and a first magnetic band disposed on the first antenna coil portion; a first housing section configured to receive the first antenna coil portion and the first magnetic band; a second antenna section including: a second antenna coil portion, and a second magnetic band disposed on the second antenna coil portion; and a second housing section configured to receive the second antenna coil portion and the second magnetic band; and obtaining measurements of a surrounding subterranean formation with the logging tool.

Clause 16: The method of clause 15, wherein the tool mandrel is operatively coupled to a drill string and introducing the logging tool into the wellbore further comprises: extending the logging tool into the wellbore on the drill string; and drilling a portion of the wellbore with a drill bit secured to a distal end of the drill string.

Clause 17: The method of clause 15, wherein introducing the logging tool into the wellbore further comprises extending the logging tool into the wellbore on wireline as part of a wireline instrument sonde.

Clause 18: The method of clause 15, wherein the logging tool further comprises: a first junction removably coupling first ends of the first and second housing sections and at least partially enclosing first ends of the first and second antenna coil portion; and a second junction removably coupling second ends of the first and second housing sections and at least partially enclosing second ends of the first and second antenna coil portions.

Clause 19: The method of clause 15, wherein the first housing section, the first antenna coil portion, and the first magnetic band are bonded together and comprise a first unitary structure, and wherein the second housing section, the second antenna coil portion, and the second magnetic band are bonded together and comprise a second unitary structure, the first and second unitary structures cooperatively forming the antenna assembly.

Clause 20: The method of clause 15, wherein the antenna assembly comprises a conductive coupler for coupling first ends of the first and second antenna coil portions to each other, the first and second antenna coil portions each include a plurality of conductive wires, and second ends of the first and second antenna coil portions are coupled to a control circuit, thereby forming a multi-loop antenna assembly.

In some embodiments, any of the clauses herein may depend from any one of the independent clauses or any one of the dependent clauses. In one aspect, any of the clauses (e.g., dependent or independent clauses) may be combined with any other one or more clauses (e.g., dependent or independent clauses). In one aspect, a claim may include some or all of the words (e.g., steps, operations, means or components) recited in a clause, a sentence, a phrase or a paragraph. In one aspect, a claim may include some or all of the words recited in one or more clauses, sentences, phrases or paragraphs. In one aspect, some of the words in each of the clauses, sentences, phrases or paragraphs may be removed. In one aspect, additional words or elements may be added to a clause, a sentence, a phrase or a paragraph. In one aspect, the subject technology may be implemented without utilizing some of the components, elements, functions or operations described herein. In one aspect, the subject technology may be implemented utilizing additional components, elements, functions or operations.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the disclosure. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference.

Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A logging tool, comprising:

a tool mandrel; and an antenna assembly disposed on the tool mandrel, the antenna assembly including: a first antenna section including:

a first antenna coil portion having a first end and a second end, and a first magnetic band disposed on the first antenna coil portion;

a first housing section configured to receive the first antenna coil portion and the first magnetic band;

a second antenna section including:

a second antenna coil portion having a first end and a second end, wherein the respective first ends of the first and second antenna coil portions are configured to operatively connect to each other, and wherein the respective second ends of the first and second antenna coil portions are configured to connect to control circuitry, and a second magnetic band disposed on the second antenna coil portion;

wherein the first magnetic band and the second magnetic band each comprise a plurality of elongated inserts; and a second housing section configured to receive the second antenna coil portion and the second magnetic band.

2. The logging tool of claim 1, further comprising a conductive coupler for coupling the respective first ends of the first and second antenna coil portions to each other to form a loop antenna of the antenna assembly.

3. The logging tool of claim 1, wherein the first and second antenna coil portions each include a plurality of conductive wires.

4. The logging tool of claim 3, wherein the respective second ends of the first and second antenna coil portions are coupled to the control circuit circuitry, thereby forming a multi-loop antenna assembly.

5. The logging tool of claim 3, wherein the first and second antenna coil portions include a same number of conductive wires.

6. The logging tool of claim 1, further comprising:

a first junction removably coupling first ends of the first and second housing sections and at least partially enclosing the respective first ends of the first and second antenna coil portions; and a second junction removably coupling second ends of the first and second housing sections and at least partially enclosing the respective second ends of the first and second antenna coil portions.

7. The logging tool of claim 1, wherein the first housing section, the first antenna coil portion, and the first magnetic band are bonded together and comprise a first unitary structure, and wherein the second housing section, the second antenna coil portion, and the second magnetic band are bonded together and comprise a second unitary structure, the first and second unitary structures cooperatively forming the antenna assembly.

8. A method, comprising:

introducing a logging tool into a wellbore, the logging tool including:

a tool mandrel; and an antenna assembly disposed on the tool mandrel, the antenna assembly including:

a first antenna section including:

a first antenna coil portion having a first end and a second end, and a first magnetic band disposed on the first antenna coil portion;

a first housing section configured to receive the first antenna coil portion and the first magnetic band;

a second antenna section including:

a second antenna coil portion having a first end and a second end, wherein the respective first ends of the first and second antenna coil portions are configured to operatively connect to each other, and wherein the respective second ends of the first and second antenna coil portions are configured to connect to control circuitry, and a second magnetic band disposed on the second antenna coil portion;

wherein the first magnetic band and the second magnetic band each comprise a plurality of elongated inserts; and a second housing section configured to receive the second antenna coil portion and the second magnetic band; and obtaining measurements of a surrounding subterranean formation with the logging tool.

9. The method of claim 8, wherein the tool mandrel is operatively coupled to a drill string and introducing the logging tool into the wellbore further comprises:

extending the logging tool into the wellbore on the drill string; and drilling a portion of the wellbore with a drill bit secured to a distal end of the drill string.

10. The method of claim 8, wherein introducing the logging tool into the wellbore further comprises extending the logging tool into the wellbore on wireline as part of a wireline instrument sonde.

11. The method of claim 8, wherein the logging tool further comprises:

a first junction removably coupling first ends of the first and second housing sections and at least partially enclosing the respective first ends of the first and second antenna coil portions; and a second junction removably coupling second ends of the first and second housing sections and at least partially enclosing the respective second ends of the first and second antenna coil portions.

12. The method of claim 8, wherein the first housing section, the first antenna coil portion, and the first magnetic band are bonded together and comprise a first unitary structure, and wherein the second housing section, the second antenna coil portion, and the second magnetic band are bonded together and comprise a second unitary structure, the first and second unitary structures cooperatively forming the antenna assembly.

13. The method of claim 8, wherein the antenna assembly comprises a conductive coupler for coupling respective first ends of the first and second antenna coil portions to each other, the first and second antenna coil portions each include a plurality of conductive wires, and the respective second ends of the first and second antenna coil portions are coupled to the control circuitry, thereby forming a multi-loop antenna assembly.

* * * * *